US007364513B2

(12) United States Patent
Krumme

(10) Patent No.: US 7,364,513 B2
(45) Date of Patent: Apr. 29, 2008

(54) GOLF CLUB HEAD WITH INSERTS FOR IMPACT FACE

(75) Inventor: John F. Krumme, Tahoe City, CA (US)

(73) Assignee: Pixl Golf Company, Menlo Park, CA (US)

( * ) Notice: Subject to any disclaimer, the term of this patent is extended or adjusted under 35 U.S.C. 154(b) by 0 days.

(21) Appl. No.: 11/261,915

(22) Filed: Oct. 31, 2005

(65) Prior Publication Data

US 2006/0189409 A1 Aug. 24, 2006

Related U.S. Application Data

(63) Continuation of application No. 10/616,984, filed on Jul. 11, 2003, now abandoned.

(51) Int. Cl.
*A63B 53/04* (2006.01)

(52) U.S. Cl. ..... 473/329; 473/342; 473/330; 473/350

(58) Field of Classification Search ..... 473/324–350
See application file for complete search history.

(56) References Cited

U.S. PATENT DOCUMENTS

| | | | | | |
|---|---|---|---|---|---|
| 456,258 | A | * | 7/1891 | Hutton | 82/1.3 |
| 732,136 | A | * | 6/1903 | Taylor | 473/331 |
| 890,836 | A | * | 6/1908 | Beale | 473/329 |
| 974,888 | A | * | 11/1910 | Jacobus | 473/342 |
| 1,094,599 | A | * | 4/1914 | Samson | 473/329 |
| 1,289,553 | A | * | 12/1918 | Sanders | 473/331 |
| 1,337,958 | A | * | 4/1920 | Reach | 473/331 |
| D57,980 | S | * | 5/1921 | Kraeuter | D21/741 |
| 1,383,654 | A | | 7/1921 | Mattern | 473/342 |
| 1,452,695 | A | | 4/1923 | Mattern | 473/332 |
| D63,284 | S | * | 11/1923 | Challis | D21/736 |
| 1,485,685 | A | * | 3/1924 | McMahon | 473/342 |
| 1,494,494 | A | * | 5/1924 | Lippincott | 473/342 |
| 1,524,731 | A | * | 2/1925 | Davis | 473/330 |
| 1,526,951 | A | * | 2/1925 | Beaumont | 473/240 |
| 1,532,545 | A | * | 4/1925 | Pedersen | 473/242 |
| 1,535,670 | A | * | 4/1925 | Kidd | 473/331 |
| 1,562,956 | A | * | 11/1925 | Guerne | 473/329 |

(Continued)

FOREIGN PATENT DOCUMENTS

EP 0710493 * 5/1996

(Continued)

OTHER PUBLICATIONS

Hodgson Daryl E., et al, "Shape Memory Alloys" viewable at www.SMA-Inc.com/SMAPpaper, 1999, retrieved from Internet on Jan. 18, 2002.

(Continued)

*Primary Examiner*—Sebastiano Passaniti
(74) *Attorney, Agent, or Firm*—T. H. P. Richardson

(57) ABSTRACT

A striking face for golf clubs, such as a driver, iron or putter comprising a plurality of bars retained in the club head body and forming the striking surface. The bars which comprise the striking face according to the invention may be designed and arranged to provide enhanced performance of a golf club. The bars may also be machined economically before assembly of the golf club head to provide a precision grooved striking face at reduced cost.

23 Claims, 7 Drawing Sheets

U.S. PATENT DOCUMENTS 1,595,589 A * 8/1926 Tyler ..... 473/332
1,618,900 A * 2/1927 Wolkerstorfer ..... 408/233
1,646,461 A * 10/1927 So Relle ..... 473/342
1,654,257 A * 12/1927 Hillerich ..... 473/342
1,659,272 A * 2/1928 Link ..... 473/342
D79,684 S * 10/1929 Munro-Spencer ..... D21/736
1,968,626 A * 7/1934 Young ..... 473/329
D138,380 S * 7/1944 Myers ..... D21/743
2,429,351 A * 10/1947 Fetterolf ..... 473/329
2,586,084 A * 2/1952 Powell ..... 407/30
3,211,455 A * 10/1965 Hyden ..... 473/329
3,455,558 A * 7/1969 Onions ..... 473/290
3,847,399 A * 11/1974 Raymont ..... 473/350
3,869,126 A * 3/1975 Thompson ..... 473/331
4,027,885 A * 6/1977 Rogers ..... 473/342
4,156,526 A * 5/1979 Huggins et al. ..... 473/329
4,252,262 A * 2/1981 Igarashi ..... 228/174
4,413,825 A * 11/1983 Sasse ..... 473/331
4,422,638 A * 12/1983 Tucker ..... 473/329
4,508,349 A * 4/1985 Gebauer et al. ..... 473/330
4,529,203 A * 7/1985 Ribaudo ..... 473/331
4,630,826 A * 12/1986 Nishigaki et al. ..... 473/329
4,679,792 A * 7/1987 Straza et al. ..... 473/329
4,681,322 A * 7/1987 Straza et al. ..... 473/329
4,740,345 A * 4/1988 Nagasaki et al. ..... 264/257
4,768,787 A * 9/1988 Shira ..... 473/331
4,884,808 A * 12/1989 Retzer ..... 473/288
4,919,177 A * 4/1990 Homma ..... 148/563
4,964,641 A * 10/1990 Miesch et al. ..... 473/330
4,999,000 A * 3/1991 Finney ..... 473/341
5,024,437 A * 6/1991 Anderson ..... 473/342
5,083,778 A * 1/1992 Douglass ..... 473/329
5,176,384 A * 1/1993 Sata et al. ..... 473/329
D340,492 S * 10/1993 Flood ..... D21/733
5,301,941 A * 4/1994 Allen ..... 473/327
5,316,304 A * 5/1994 Yost ..... 473/330
5,358,249 A * 10/1994 Mendralla ..... 473/331
5,403,007 A * 4/1995 Chen ..... 473/342
5,405,136 A * 4/1995 Hardman ..... 473/342
5,407,196 A * 4/1995 Busnardo ..... 473/246
5,408,554 A * 4/1995 Cryan et al. ..... 385/43
5,445,386 A * 8/1995 Marshall ..... 473/251
5,447,311 A * 9/1995 Viollaz et al. ..... 473/342
5,458,332 A * 10/1995 Fisher ..... 473/251
5,482,282 A * 1/1996 Willis ..... 473/342
5,489,094 A * 2/1996 Pritchett ..... 473/342
D368,126 S * 3/1996 Magerman et al. ..... D21/743
5,505,450 A * 4/1996 Stuff ..... 473/329
5,524,331 A * 6/1996 Pond ..... 29/527.4
5,531,439 A * 7/1996 Azzarella ..... 473/331
5,542,675 A * 8/1996 Micciche et al. ..... 473/329
5,573,469 A * 11/1996 Dekura ..... 473/314
5,575,472 A * 11/1996 Magerman et al. ..... 29/530
5,620,381 A * 4/1997 Spalding ..... 473/329
5,620,382 A * 4/1997 Cho et al. ..... 473/331
5,674,132 A * 10/1997 Fisher ..... 473/290
5,688,186 A * 11/1997 Michaels et al. ..... 473/290
5,688,190 A * 11/1997 Rowland et al. ..... 473/330
5,690,562 A * 11/1997 Sturm ..... 473/340
5,704,850 A * 1/1998 Shieh ..... 473/324
5,709,616 A * 1/1998 Rife ..... 473/330
5,716,290 A * 2/1998 Baker et al. ..... 473/313
5,738,925 A * 4/1998 Chaput ..... 428/101
5,766,093 A * 6/1998 Rohrer ..... 473/329
5,772,529 A * 6/1998 Ruth, Jr. ..... 473/327
5,785,610 A * 7/1998 Birmingham ..... 473/331
5,807,190 A * 9/1998 Krumme et al. ..... 473/342
5,879,243 A * 3/1999 Hackman ..... 473/342
D411,275 S * 6/1999 Bottema et al. ..... D21/759
5,921,871 A * 7/1999 Fisher ..... 473/329
5,924,939 A * 7/1999 Grace et al. ..... 473/324
D415,809 S * 10/1999 Bottema et al. ..... D21/759
6,007,435 A * 12/1999 Chern ..... 473/342
6,089,993 A * 7/2000 Woodward et al. ..... 473/331
6,193,615 B1 * 2/2001 Hirota ..... 473/329
6,267,691 B1 * 7/2001 Dammen ..... 473/329
6,554,721 B1 * 4/2003 Woodward et al. ..... 473/331
6,849,004 B2 * 2/2005 Lindsay ..... 473/330
2003/0027659 A1 * 2/2003 Brown ..... 473/329
2005/0009623 A1 * 1/2005 Dickinson ..... 473/329
2005/0054461 A1 * 3/2005 Pakarnseree et al. ..... 473/329
2005/0075193 A1 * 4/2005 Otoguro ..... 473/346
2005/0130764 A1 * 6/2005 Frame ..... 473/340
2005/0255930 A1 * 11/2005 Johnson ..... 473/244
2006/0154746 A1 * 7/2006 Hagood et al. ..... 473/345
2006/0191403 A1 * 8/2006 Hawkins et al. ..... 89/36.05

FOREIGN PATENT DOCUMENTS

GB 2185891 * 8/1987
JP 3-23877 * 1/1991

OTHER PUBLICATIONS

Ellis, Jeffrey B., "More Materials.", The Club Makers Art, Zephyr Productions Inc., Oak Harbor, WA, 1997, pp. 319-357.
PCT International Preliminary Report on Patentability on PCT/US2004/022572, dated Jan. 16, 2006.

* cited by examiner

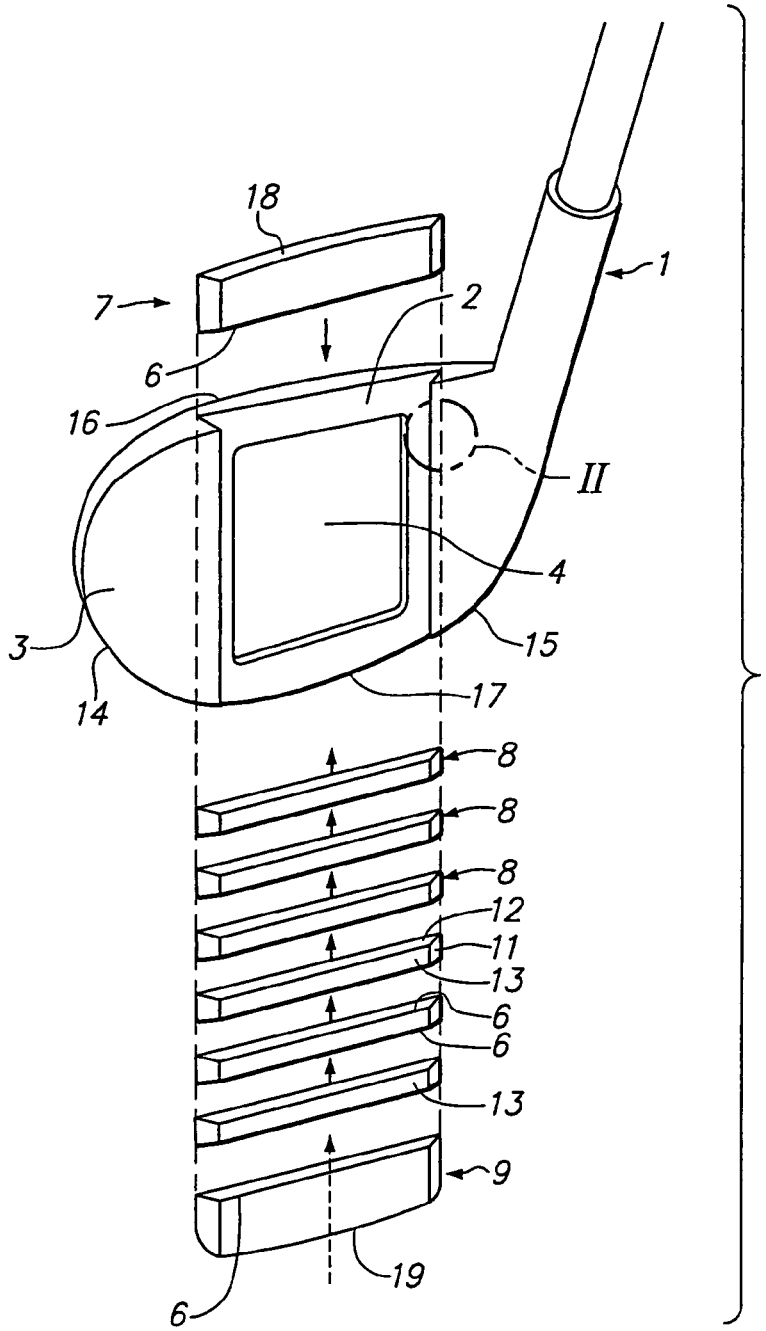
FIG. 1
FIG. 2
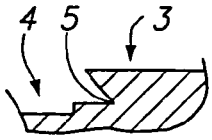
FIG. 3
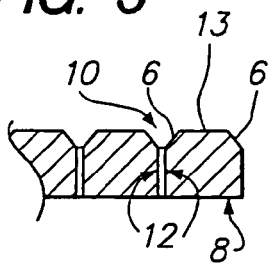

GOLF CLUB HEAD WITH INSERTS FOR IMPACT FACE

CROSS-REFERENCE TO RELATED APPLICATION

This application is a continuation application of application Ser. No. 10/616,984, filed on Jul. 11, 2003, now abandoned the contents of which are hereby incorporated by reference in their entirety for all purposes.

FIELD OF THE INVENTION

This invention relates to golf club heads for golf clubs such as drivers, irons and putters.

BACKGROUND OF THE INVENTION

Many proposals have been made to design golf clubs which provide improved control over, and feel for, the golf ball, for example by providing grooves on the impact face of the golf club head. Reference may be made, for example, to U.S. Pat. Nos. 1,383,654, 1,452,695, 1,494,494, 5,176,384, 5,358,249, 5,405,136, 5,542,675, 5,766,093, 5,807,190 and 6,007,435. The disclosure of each of those patents is incorporated herein by reference for all purposes. Not all of the proposals comply with the USGA Rules of Golf, Rule 4 and Appendix II, which require that, for clubs other than putters, "the whole of the impact area" of the club face "must be of the same material" and that impact area markings, such as grooves, should comply with certain requirements. The "impact area" of a club head is referred to herein as the "impact face".

SUMMARY OF THE INVENTION

In a first preferred aspect, this invention provides golf club head comprising (1) a club head body, and (2) a faceplate which (i) provides an impact face and (ii) comprises a plurality of bars which can be individually deflected, without permanent damage, in a direction perpendicular to the impact face when the impact face strikes a golf ball.

In a second preferred aspect, this invention provides a method of making a golf club head, for example a golf club head according to the first preferred aspect of the invention, the method comprising (A) providing a club head body; and (B) forming an impact face on the club head body, the impact face comprising, after step (B), a plurality of bars which can be individually deflected, without permanent damage, in a direction perpendicular to the impact face when the impact face strikes a golf ball.

The composition, dimensions and arrangement of the bars are preferably chosen so that the impact face has a desired response when a golf ball impacts it at different positions across the insert. In some embodiments, the sidewalls of the bars are pre-shaped so that adjacent sidewalls provide grooves of desired dimensions on the impact face. For example, half grooves are machined onto the appropriate sidewalls so that, when the bars are incorporated into the faceplate, the adjacent half grooves form grooves on the impact face. This allows individual bars to be economically mass produced before being incorporated into an inset in the face of a club head. In some embodiments, the bars are retained in the recess by a dovetail geometry on the ends of the bars. In a preferred embodiment, a top and/or bottom retainer element is pressed into place in the dovetail in order to lock the bars into position.

Preferred club heads of the invention can provide important advantages by comparison with conventional golf clubs in which the impact face is provided by a single piece of material (and, therefore, has a "trampoline" geometry with a centroidal sweet spot outside of which performance drops off quickly). Such advantages can include:

- a more desirable feel and larger "sweet spot" which results in improved uniformity of response upon impact for off-center hits and a reduction in the effect of off-center hits on the path of the struck ball, and
- a desired balance between maximized distance and control.

Preferred club heads of the invention, particularly club heads for irons and drivers, conform with the USGA Rules of Golf with respect to grooves on, and uniformity of material of, the impact face.

Preferred embodiments of the method of the invention provide an improved method of manufacturing a club head having grooves in its impact face.

BRIEF DESCRIPTION OF THE DRAWINGS

FIG. 1 shows schematically an exploded view of a golf club head incorporating a plurality of bars in accordance with the invention.

FIG. 2 shows a detail section view of the edge of the recess of FIG. 1 at area II including a dovetail mating surface.

FIG. 3 shows a detail view of two adjacent bars in cross section.

DETAILED DESCRIPTION OF THE INVENTION

Figure 4:
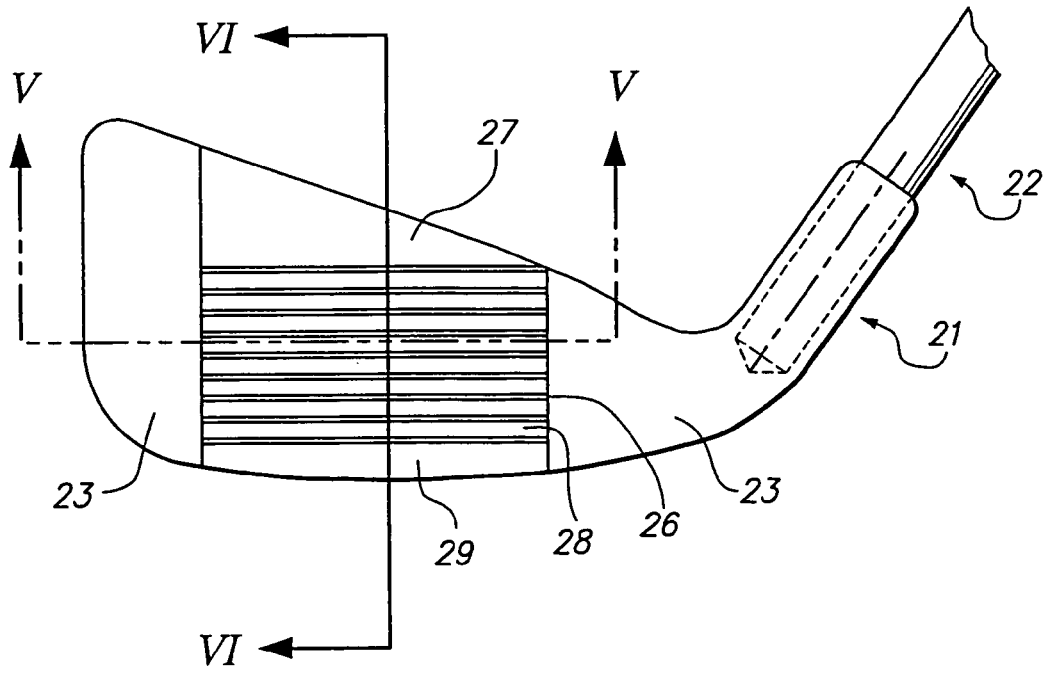
FIG. 4 shows an exemplary embodiment of an assembled "bars" iron.
Figure 5:
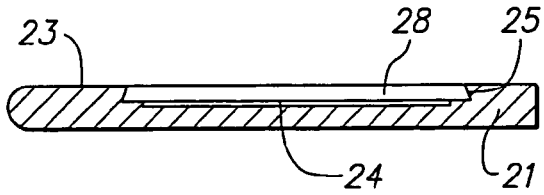
FIG. 5 shows a cross-section through the line V-V of FIG. 4.
Figure 6:
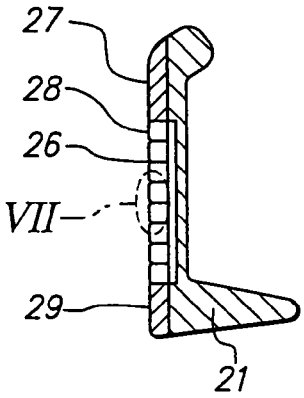
FIG. 6 shows a cross-section through the line VI-VI of FIG. 4.
Figure 7:
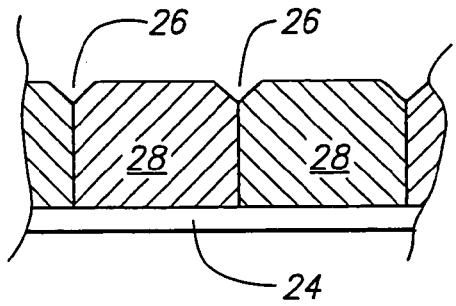
FIG. 7 shows an expanded view of two bars in area VII of FIG. 6.

Referring for example to FIGS. 1-14, the club head body 1,21,31,42 may be made of any material suitable for the construction of golf clubs and may include additional features such as a sole-plate on wood type clubs as are known in the art. The club head body 1 has a recess 2 in its front face 3,23,33,45 and optionally a cavity 4,24 or through hole within the recess, behind the impact face. A plurality of machined or otherwise formed bars 8,28,39,40,48,49 are fit contiguously into the recess in the face of the club head to form a faceplate having an impact face. The bars have three primary dimensions, length, width, and depth, with a frontwall 13 bounded by the two largest dimensions, length and width, sidewalls 12 bounded by the length and depth, and endwalls bounded by the width and depth. The depth dimension may be uniform or variable lengthwise as may the thickness of the material. Each endwall 11 may comprise a single surface which is perpendicular or angled with respect to the frontwall, e.g., the endwall can be shaped to form an interlocking surface which can engage a surface 5,25 cast or machined into the edge of the recess in the club head body thereby retaining the bars in the recess. The bars can be individually deflected in the direction perpendicular to the impact face when the impact face impacts a golf ball, and are preferably assembled in the recess with the sidewalls 12 in contact with each other. The frontwalls may be polished or treated mechanically or chemically to provide a textured impact face. The bars may fill the recess or be bordered by retainers which can be shaped to match the unfilled portion of the recess. If desired, a closed cavity may be provided beneath the bars, or the backside of the bars may be partially exposed through an opening in the rear surface of the club head.

The side edges 6 of the bars' frontwalls 13 may be machined before assembly such that a groove 10,26 is formed between adjacent bars and/or between the bars and any retainers 7,9,27,29,34,35,44,47. A bar 37,48 side edge may be machined to provide a full length groove between adjacent bars. Alternatively, the bars 38,49 may be machined to provide a less than full length groove between adjacent bars. The bars may also be machined to form grooves in the frontwalls between the edges. The groves may be any shape (e.g., V shaped, square, or round); although, the V shaped grooves formed by two adjacent beveled edges are preferred. This allows for the economical production of precision machined grooves on a golf club face.

The bars may be retained in position in a club head by an interlocking arrangement, by bonding such as metallurgical or adhesive bonding or a combination thereof. For example, the bars may be retained in the club face by mating edges 5 forming a dovetail or other suitable geometry cast or machined into the recess 2 in the club head, e.g., spaced apart vertically or horizontally extending mating surfaces at opposed edges of the recess. In a preferred embodiment, the assembly of a "bars" iron is as illustrated in FIGS. 1-3. A dovetail slot at opposed ends of a recess is machined into the heel 15 and toe 14 of the club head face 3. A bottom retainer 9, shaped at the bottom edge 19 to match the geometry of the bottom 17 of the club and having an interlocking surface at each end shaped to engage the dovetail slot, is press fit into the bottom of the dovetail. Typically six to eight bars 8 with the adjacent edges 6 machined at a 45 degree angle to a depth of 0.01 to 0.02 inches are stacked tightly in the dovetail slot. A retainer 7 shaped at the top edge 18 to match the geometry at the top 16 of the club head and having an interlocking surface at each end shaped to engage the dovetail slot is press fit into place above the stack securing the bars in position.

As illustrated in FIG. 4, a bars iron may present the appearance of a conventional iron with horizontal grooves 26 formed at the contiguous edges of adjacent bars 28. The club head body 21 is connected to a shaft 22 in the manner well understood in the art. The top and bottom retainers 27,29 may be of material similar to the body or may be chosen for aesthetic or mechanical properties. As seen in sectional views (FIGS. 5-7), the bars 28 are backed by a small cavity 24 to permit deflection of the bars upon impact. The mating of the angled bar ends with the dovetail slot 25 at the edges of the recess securely retains the bars in the club head body.

A further feature of the "bars" approach to providing an insert for a golf club having an impact face is that the bars can be of any desirable material. For example, in putters it is desirable to achieve a soft feel so a polymeric material with a low modulus of elasticity may be selected for the bars. In an iron type club a highly elastic material with a non-linear modulus like NiTi may be selected for its ability to absorb and recover from high energy impacts. In a wood type club, materials of the highest hardness may be used to maximize flight distance.

Figure 8:
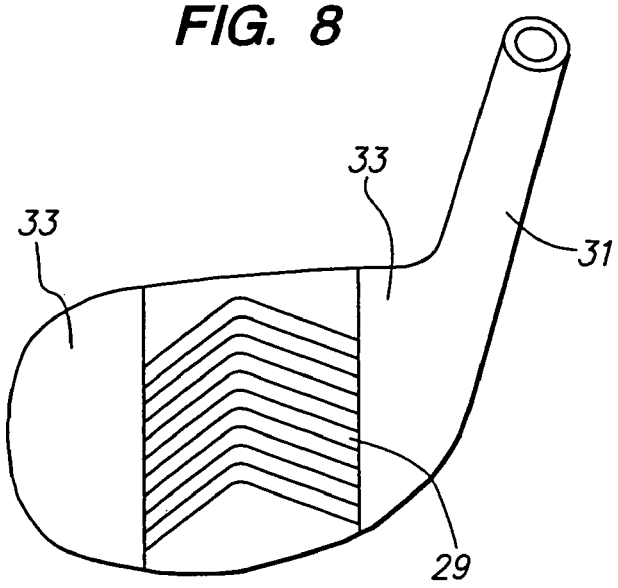
FIGS. 8-10 show exemplary alternative embodiments according to the invention wherein the bars are "V" shaped and form a chevron pattern.
Figure 9:
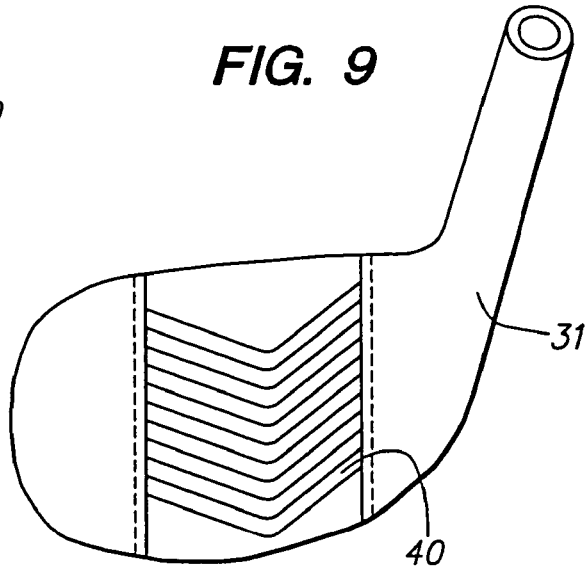
Figure 10:
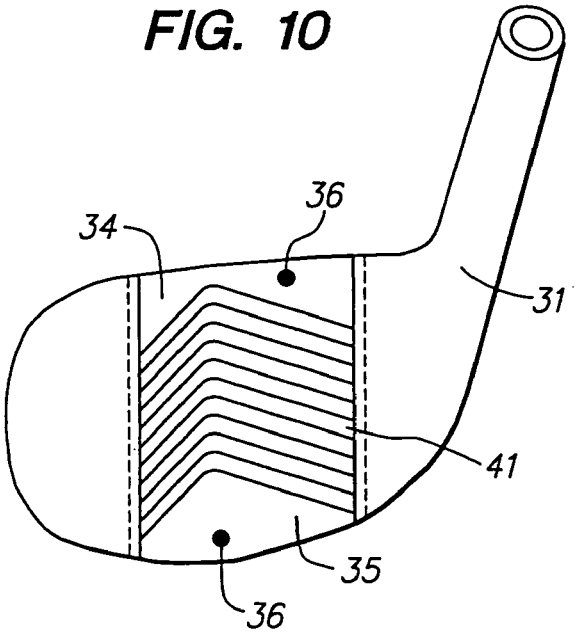
Figure 11:
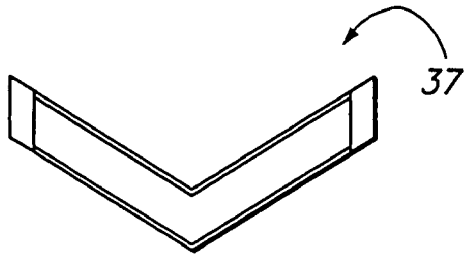
FIGS. 11-12 show two exemplary "V" shaped bars.
Figure 12:
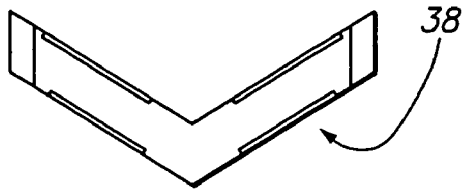

The mechanical properties of the impact face may be influenced by varying the length, width, and arrangement of the bars. The bars may be rectilinear (i.e. straight) as in FIGS. 1,4,13-14 or shaped with a curve or bend as illustrated in FIGS. 8-10. Straight bars may be arranged to extend horizontally as in FIGS. 4,13 vertically as in FIG. 14, or at an angle relative to the plane of the ground when the club head is properly swung. As seen in FIGS. 8-10, "V" shaped bars 37-41, which may be symmetric 39,40 (FIGS. 8-9) or asymmetric 41 (FIG. 10), may be assembled in a V-down (FIGS. 8,10) or V-up (FIG. 9) chevron pattern. As illustrated in FIG. 10, retainers 35 may be secured by pins 36.

Figure 13:
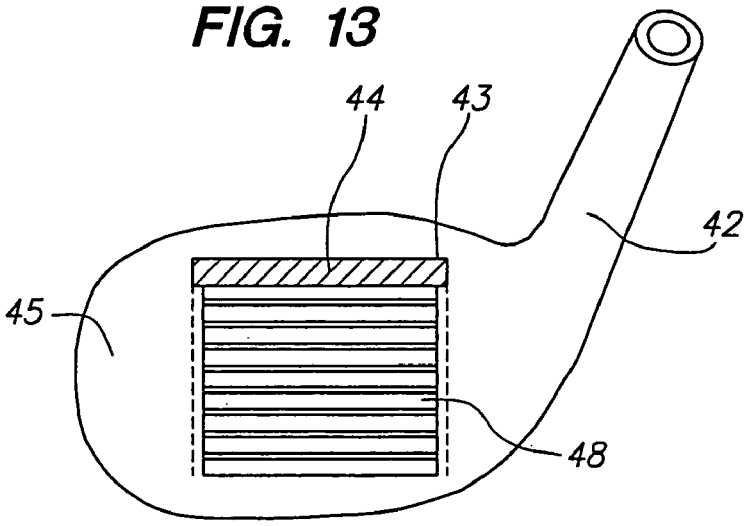
FIGS. 13-14 show alternative embodiments wherein the bars are inserted by a relieved end slot and retained by a single press-fit bar.
Figure 14:
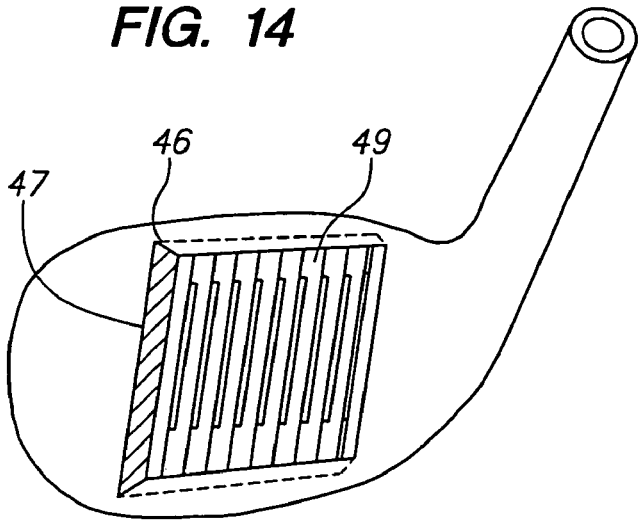

As illustrated in FIGS. 13-14, a retaining dovetail recess need not open to any one side, top, or bottom, of the club head face 45. Rather, bars 48,49 may be inserted via a relieved end slot 43 and retained by a press-fit or pinned final retainer bar 44, 47. Vertical bars, as illustrated in FIG. 14 may be chosen to be uniform or vary in thickness and/or width towards the toe and heel. Thicker bars at outer ends of the club face may be used to provide hook and slice correction.

Figure 15:
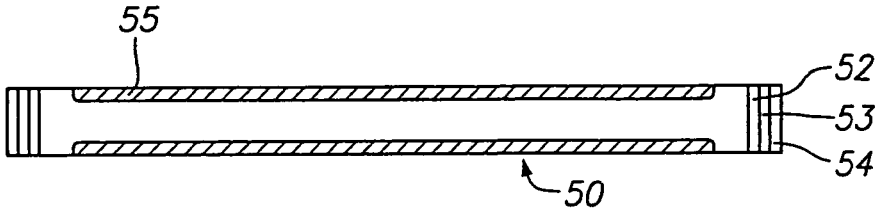
FIGS. 15-16 show an example of a multi-layer bar in two views in accordance with the invention.
Figure 16:
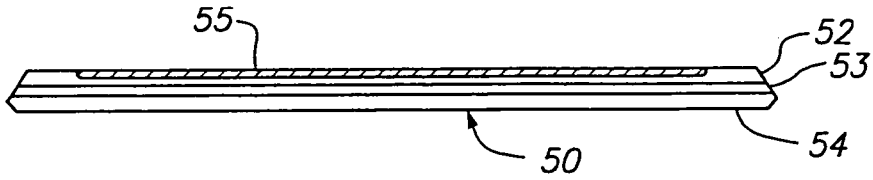

As illustrated in FIGS. 15-16, the bars may be formed of uniform material or of laminated layers 52,53,54. Laminated bars 50 may be designed to combine various material properties such as a hard surface with vibration damping, and shape memory. For example a beta titanium front surface layer 52 may be machined with groove forming indentations 55. This provides the surface with high hardness, abrasion resistance and good strain recovery. This layer 52 may be bonded to a second layer 53 of polyurethane elastomer to provide vibration damping. A third layer 54 of super-elastic NiTi provides the bar 50 with a high degree of strain recovery from deflection and further vibration damping. As another example, thin layers of stainless steel or Beta Titanium may be laminated to provide a bar capable of much higher deflection without permanent damage. Such a bar will maintain contact with the ball longer for energy transfer and enhanced transfer of spin upon impact. Any number of layers may be laminated to form a single bar. The layers may or may not be the same thickness. The front surface layer of all the bars can be of the same material across an impact face to satisfy present USGA rules.

Figure 17:
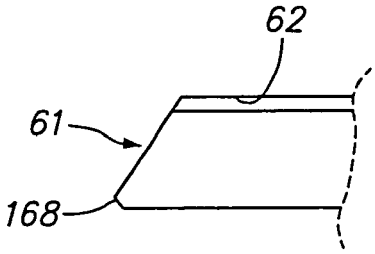
FIG. 17 shows, in detail, a bar end design according to a preferred embodiment of the invention.
Figure 18:
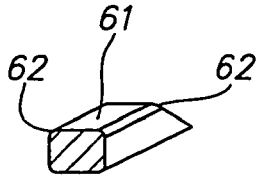
FIGS. 18-22 show various exemplary bar end sections in perspective wherein the bar thickness is varied across the width of the bar.
Figure 19:
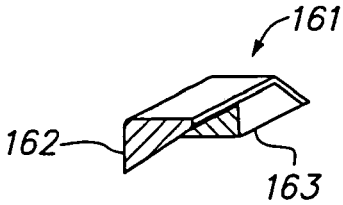
Figure 20:
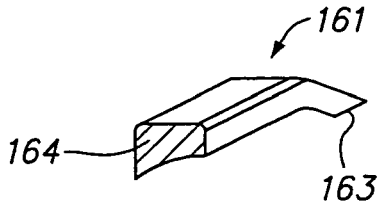
Figure 21:
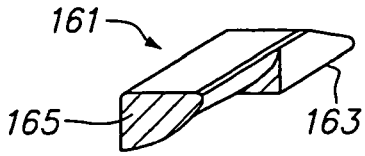
Figure 22:
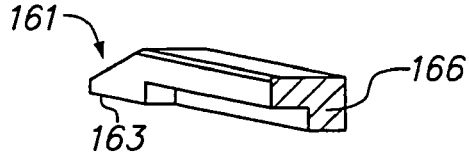
Figure 23:
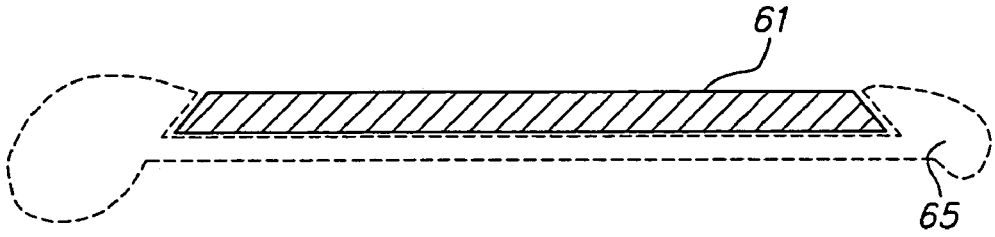
FIGS. 23-28 show various exemplary bars in accordance with the invention wherein the bar cross section is varied along the long dimension.
Figure 24:
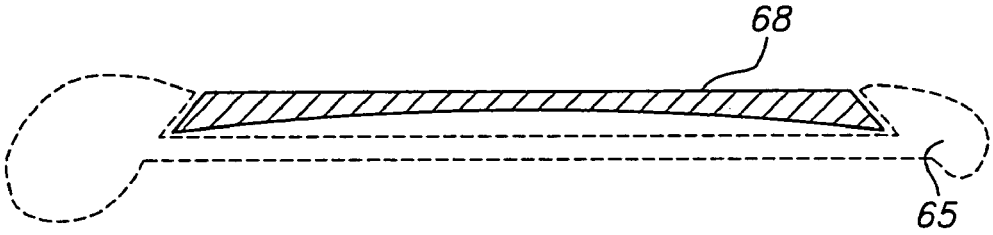
Figure 25:
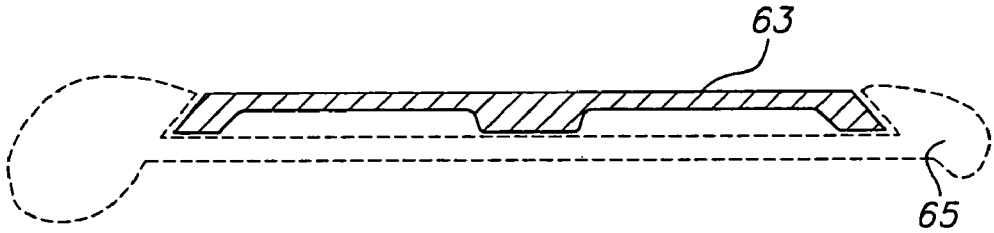
Figure 26:
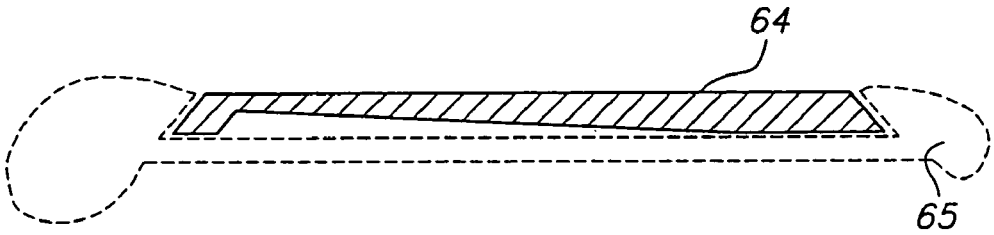
Figure 27:
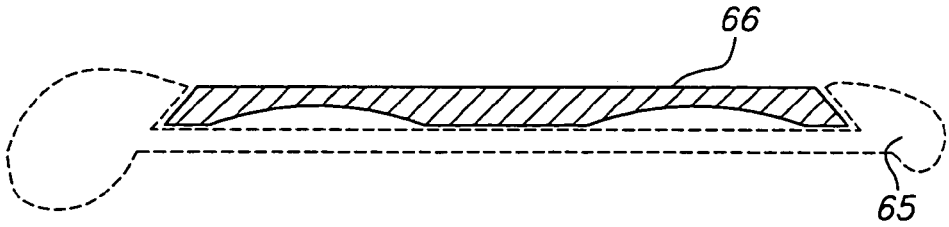
Figure 28:
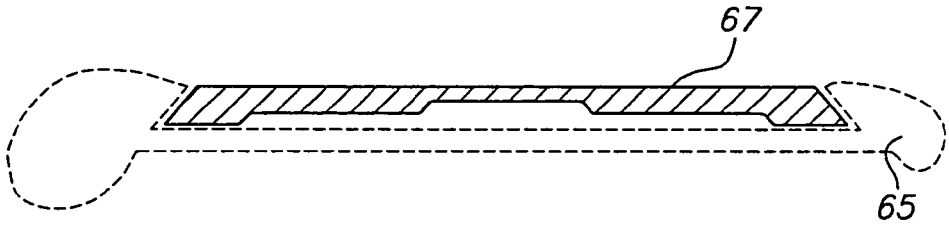
Figure 29:
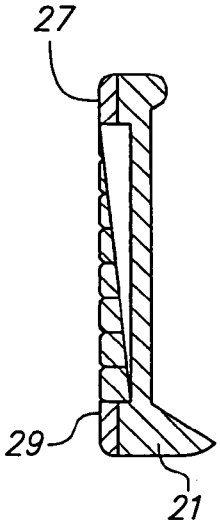
FIGS. 29-32 show in cross section several exemplary embodiments of iron type clubs according to the invention incorporating stacked bars of varied thickness.
Figure 30:
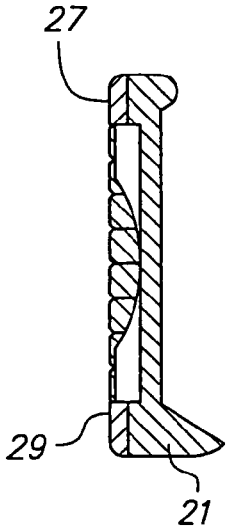
Figure 31:
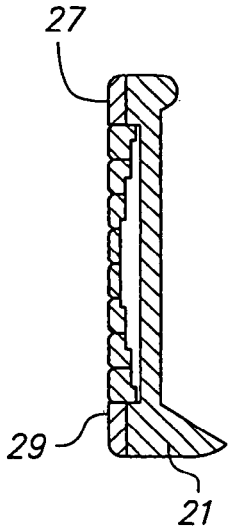
Figure 32:
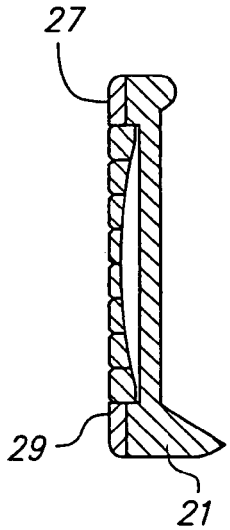

As illustrated in FIG. 17, in a preferred embodiment of the invention, a bar 61 endwall is angled to form an interlocking surface which can engage the dovetail geometry of the spaced apart edges of the recess. The top may be machined at the side-edge to form a half-groove 62. Preferably, a small chamfer 168 at the tip of the dove-tail wedge allows the bars to be more easily assembled in the recess and allows greater flexure of the bars at impact.

As illustrated in FIGS. 18-22 the bars 61,161 may have a uniform thickness (FIG. 18) or varied thickness across the width of the bars (FIGS. 19-22). The cross section thickness may vary linearly 162 or non-linearly in concave 164, convex 165, or stepped 166 shapes. The bar ends 163 are preferably the full uniform thickness in order to engage the club head body at the edges of the recess. Groups of such bars may be chosen for example to vary the thickness profile across the stack as illustrated in FIGS. 29-32.

As illustrated in FIGS. 23-28 the bars 61,63,66,67,68 may have a uniform (FIG. 23) or varied thickness (FIGS. 24-28) lengthwise linearly or non-linearly. Thinner bars will feel softer and provide a larger zone of uniform response than thicker bars. A bar with a thinner center 67,68 will exhibit a larger sweet spot and directional correction for off center impacts. A continuous curve 68 provides a uniform stress distribution across the face while a stepped profile 67 creates discrete zones of response. A bar with a thin profile except a central bump 63 will provide a softened feel with controlled face deflection while retaining a stiff follow-on for distance. A bar with thin outer sections 66 reduces harsh feel of toe and heel impacts. A bar with an asymmetric thickness profile 64 will provide asymmetric response to impact. The thicker end of the bar will be stiffer, thus a golf ball is directed toward the thinner bar end. This design may be used for correction of a chronic hook or slice. Similar considerations apply to the design of stacks of bars such as illustrated in FIGS. 29-32. By application of these principles in choosing and stacking bars in a club face, many different golf ball impact responses can be achieved.

The invention can be implemented in variations of the foregoing embodiments. For example, the length and direction of the bars could be varied as well within a single club face and/or a configuration of variously treated short bars could be bonded to backing bars and/or provided with mating surfaces in adjacent endwalls. Further, bars of uniform but differently processed (e.g. heat treated) material may used to provide a more even impact response across an impact face and/or smaller bars might be used to heighten this effect, e.g., short bars may be machined to provide mating surfaces at the end walls. Alternatively, short bars may have flat end walls and rely solely on adhesion to a backing bar for retention in the club head. The directions of bars may change one or more times across the impact face. In arrangements of this type, the adjacent endwalls and sidewalls of orthogonal bars may be shaped to provide mating surfaces to retain bars not in contact with the edges of the recess. Bars of mixed shape and orientation may be combined in various arrangements to provide desired properties such as differing groove and surface deflection directions as a function of the impact position on the impact face. Multiple layers of individual bars may be inserted in a club head recess, e.g., an outer layer of bars may be retained in the recess over a backing plate comprising an inner layer of backing bars to provide a fine tuned surface response. The exposed layer may be of a thin, uniform, and elastic material such as NiTi. Backing layers may be of any hardness, cross-section, and arrangement. In a preferred embodiment, the surface bars mate with edges of the recess for purposes of retention.

An advantage of preferred embodiments of the invention is the ability to provide a more uniform response to off-center hits. This can be accomplished with the "bars" approach by varying the thickness of the material of the bars over the impact face. Also, the mechanical properties may vary at different points in the impact face while presenting a uniform material surface. For example, bars heat-treated or otherwise processed in different ways either uniformly lengthwise or variably along a bar's length would allow the impact face to be fine tuned for its response characteristics. Multi-layer bars may incorporate several laminations of different materials specifically chosen for vibration dampening properties or elastic response or both. The various configurations of shape, orientation, and thickness of can be used to offset inherent imbalance and inertia effects in a club when hit off-center or to help compensate an inherently faulty swing. The back-face of the bars may comprise structural features such as a bump or island for the purpose of limiting the travel of a deflected bar upon impact with a ball.

Any of the previous examples might be used in conjunction. For example, alternating layers of vertical and horizontal bars might be used to fine tune the response of the impact face. Likewise, any other combination of the exemplary designs might be implemented varying the thickness, width, length, material, properties, and direction.

In addition to the forgoing description, the invention and preferred embodiments thereof may be further understood by consideration of the following examples.

EXAMPLES

Iron with Enhanced Off-Center Impact Response

Any of the long (i.e., irons numbered 1 to 5) type clubs may be enhanced for distance with consistency of control by providing an impact face with a larger area of uniform impact response. To this end, a club head body is provided with a recess in the form of a vertical dovetail slot in the face. A polished steel retainer, flat on top with the top front edge machined at a 45 degree angle to a depth of 0.02 inches, contoured on the bottom to match the bottom and sole of the club face, and machined into a dovetail wedge at each end, is press fit into the bottom of the dovetail slot. A series of 10 NiTi bars, about 0.13 inches wide, machined to a 10 degree angle at each end (with a 0.015 inch 45 degree chamfer at the wedge tip) are sized to fit snugly in the dovetail slot. The bars are about 0.1 inches deep at the ends of the frontwall. The side-edges of the front wall are machined at a 45 degree angle to a depth of 0.02 inches. The back side of each bar is machined in a parabolic contour lengthwise with the center of the $6^{th}$ bar machined to approximately half its depth; upper bars are machined more deeply than lower bars in sequence stepwise such that a rear view of the bars stacked in order shows a smooth parabolic contour along the heel to toe direction of the bars and a step-wise linear progression from top to bottom of the stack. The bars are stacked tightly together in the slot forming a precision V shaped groove at each adjacent edge. A top retainer of polished steel, flat on the bottom with the bottom front edge machined at a 45 degree angle to a depth of 0.02 inches, contoured on the top to match the top of the club face, and machined into a wedge at each end to fit tightly in the dovetail slot, is press fit into the top of the dovetail slot. In an on-center impact, the shaped impact deflection focuses energy otherwise dispersed across the face to a center line of thrust. In the case of a slightly off-center impact the shaped deflection of the face re-focuses the flight of ball in the intended direction with minimal loss of distance. The top to bottom thickness progression smooths and expands the sweet spot vertically for high and low impacts. Balls struck at the bottom of the impact face are increasingly directed upward to the desired loft and balls struck near the top of the impact face have a softer feel and longer contact time with the impact face.

Irons with Enhanced Spin and Directional Control.

An iron type club is provided with an insert of pointing "V" shaped bars as illustrated in FIGS. 8-10. The V shape of the bars and grooves control the spin imparted to a golf ball upon impact. Upward pointing V bars (FIG. 8) impart top-spin. Top-spin may be desired to keep a ball's trajectory low, for example when hitting against the wind, and to increase forward fairway bounce and roll. Downward pointing V bars (FIG. 9) impart backspin. Backspin may be desired to increase aerodynamic lift of a ball in flight or to limit a ball's forward roll in chip-shots. The V shaped bars are inherently stiffer near the heel and toe, thus directing a ball hit on the heel or toe of the club toward center. An asymmetric chevron can be arranged to stiffen the toe or heel thus selectively shifting the sweet-spot.

The various illustrations demonstrate the potential to change properties across the club face while still conforming, if desired, with the one material constraint of the USGA rules. Numerous alternative arrangements, bar treatments, shapes, materials, and retaining arrangements may be imagined.

The foregoing has described the principles, preferred embodiments and mode of operation of the present invention. However, the invention should not be construed as being limited to the particular embodiments discussed. Thus the above-described embodiments should be regarded as illustrative rather than restrictive, and it should be appreciated that variations may be made in those embodiments by those skilled in the art without departing from the scope of the present invention as defined by the following claims.

What is claimed is:

1. A golf club head which comprises (1) a club head body, and (2) a faceplate which (i) provides an impact face, and (ii) comprises a plurality of bars which can be individually deflected, without permanent damage, in a direction perpendicular to the impact face, when the impact face strikes a golf ball;

the club head body comprising a recess having a pair of spaced-apart mating edges, the bars having endwalls comprising interlocking surfaces which engage the mating edges and secure the bars to the club head, the interlocking surfaces being a sliding fit with the mating edges, and the golf club head further comprising a retainer which locks the bars in place.

2. A golf club head which comprises (1) a club head body having a recess therein, and (2) a faceplate comprising a plurality of bars which extend across the recess and provide an impact face;

each of the bars being individually deflectable, without permanent damage, in a direction perpendicular to the impact face, when the impact face strikes a golf ball, each of the bars having a frontwall, a rearwall, two sidewalls and two endwalls, the frontwalls of the bars being composed of the same material and providing the impact face, and at least one of the frontwalls, when the impact face strikes a golf ball, being directly contacted by the golf ball, and at least one of the sidewalls of each bar being in direct contact with the sidewall of an adjacent bar.

3. A golf club head according to claim 2 wherein there is a void behind the bars.

4. A golf club head according to claim 3 wherein the rearwalls of at least some of the bars are exposed on the rear surface of the golf club.

5. A golf club head according to claim 3 wherein the recess has a continuous back, and the depth of the recess is less than one half the thickness of the faceplate.

6. A golf club head according to claim 2 wherein the bars are straight.

7. A golf club head according to claim 2 wherein the bars form a chevron pattern.

8. A golf club head according to claim 2 wherein edges of the frontwalls are shaped so that adjacent bars form grooves on the impact face.

9. A golf club head according to claim 8 wherein a first group of bars includes beveled edges extending end to end of the bars along the frontwalls, and a second group of the bars includes beveled edges extending along only part of the frontwalls.

10. A golf club head according to claim 2 wherein at least some of the bars comprise two or more laminated layers.

11. A golf club head according to claim 2 wherein the recess has a pair of spaced-apart mating edges, and the endwalls comprise interlocking surfaces which engage the mating edges and secure the bars to the club head.

12. A golf club head according to claim 11 wherein the interlocking surfaces are a sliding fit with the mating edges, and the golf club head further comprises a retainer which locks the bars in place.

13. A golf club head according to claim 2 wherein the bars are metallurgically bonded to the club head body.

14. A golf club head according to claim 2 wherein the bars are adhesively bonded to the club head body.

15. A golf club head according to claim 2 which comprises a backing plate behind the bars providing the impact face, the backing plate comprising a plurality of bars.

16. A golf club head according to claim 2 wherein the recess has a back, and at least one of the bars has a rearwall which comprises a structural feature which limits the deflection of the bar against the back of the recess when the impact face strikes a golf ball.

17. A golf club head according to claim 2 wherein at least one of the bars has a depth which varies along its length.

18. A golf club head which comprises (1) a club head body having a recess therein, and (2) a faceplate comprising a plurality of bars which extend across the recess and provide an impact face;

each of the bars being individually deflectable, without permanent damage, in a direction perpendicular to the impact face, when the impact face strikes a golf ball, each of the bars having a frontwall, a rearwall, two sidewalls and two endwalls, the frontwalls of the bars being composed of the same material and providing the impact face, at least one of the sidewalls of each bar being in contact with the sidewall of an adjacent bar, there being a void behind the bars, and each of the bars being secured to the club head body only at end sections of the bar.

19. A golf club head according to claim 18 wherein at least one of the frontwalls of the bars, when the impact face strikes a golf ball, is directly contacted by the golf ball.

20. A golf club head which comprises (1) a club head body having a recess therein, and (2) a faceplate comprising a plurality of bars which extend across the recess and provide an impact face;

each of the bars being individually deflectable, without permanent damage, in a direction perpendicular to the impact face, when the impact face strikes a golf ball, each of the bars having a frontwall, a rearwall and two sidewalls, the frontwalls being composed of the same material and providing the impact face, and at least one of the frontwalls, when the impact face strikes a golf ball, being directly contacted by the golf ball, and the rearwalls being exposed on the rear surface of the golf club.

21. A golf club head according to claim 20 wherein each of the bars is secured to the club head body only at end sections of the bar.

22. A golf club head according to claim 21, wherein each of the bars is composed of the same metal.

23. A golf club head according to claim 22, wherein each of the bars is metallurgically bonded to the club head body.

* * * * *